United States Patent [19]

Gunnewig

[11] Patent Number: 4,509,942

[45] Date of Patent: Apr. 9, 1985

[54] FULLY JACKETED CENTRIFUGE WITH A HELICAL CONVEYOR

[75] Inventor: Hubert Gunnewig, Oelde, Fed. Rep. of Germany

[73] Assignee: Westfalia Separator AG, Oelde, Fed. Rep. of Germany

[21] Appl. No.: 629,938

[22] Filed: Jul. 12, 1984

[30] Foreign Application Priority Data

Jul. 21, 1983 [DE] Fed. Rep. of Germany ..... 3326310

[51] Int. Cl.[3] ..... B04B 1/20

[52] U.S. Cl. ..... 494/53; 494/56

[58] Field of Search ..... 494/52, 53, 54, 55, 494/35, 27, 29, 23, 22, 56; 210/360.1, 380.3

[56] References Cited

U.S. PATENT DOCUMENTS 4,069,967 1/1978 Crosby ..... 494/53

4,298,159 11/1981 Epper ..... 494/35

4,339,072 7/1982 Miller ..... 494/52

4,451,247 5/1984 Brunner ..... 494/52

*Primary Examiner*—Robert W. Jenkins

*Attorney, Agent, or Firm*—Sprung Horn Kramer & Woods

[57] ABSTRACT

A fully jacketed centrifuge with a helical conveyor for separating mixtures of solids and liquid has apertures below the surface of the liquid in the jacket of the drum. Some of the centrifuges solids are let off through the apertures. Inside the helical conveyor is, in addition to one inlet space for the mixture of solids and liquids, another inlet space that has an access and that communicates with channels that extend in the vicinity of the apertures into the vicinity of the jacket. The apertures are positioned in interchangeable mouthpieces. The concentration of solids flowing off out of the apertures is controlled by constantly returning part of the solids that emerge from the flowoff through the access, the second inlet space, and the channels into the vicinity of the apertures.

11 Claims, 4 Drawing Figures

FULLY JACKETED CENTRIFUGE WITH A HELICAL CONVEYOR

BACKGROUND OF THE INVENTION

The present invention relates to a fully jacketed centrifuge with a helical conveyor for separating mixtures of solids and liquid, in which the mixture of solids and liquid is fed into the conveyor through an inlet space that has an access and some or all of the centrifuged solids are extracted through extraction apertures located below the surface of the liquid in the jacket of the drum.

A centrifuge of this type is known, for example, from German OS No. 2 930 581. One drawback of this known centrifuge is that a constant volume flows out of the apertures on account of their diameter. Depending, therefore, on the amount of solids in the centrifuge access, the solids will flow out of the apertures at a varying consistency or the centrifuge must be stopped so that the diameter of the apertures can be adjusted to the volume of solids. When the volume of solids is very low however, the apertures must be very small and will easily clog up.

German OS No. 2 942 451 accordingly proposes controls that are provided with a mechanism to open and close the apertures. The controls consist of a baffle that is mounted on the helical portion of the conveyor and is in operating communication with the apertures. The baffle is designed so that the difference in rotations per minute between the helix and the drum jacket will alternately block off and release the apertures. Controls of this type are very expensive to manufacture and necessitate a separate drive mechanism. It is not sufficient to vary the differential speed in order to control the volume extracted. The differential speed must, rather, be irregular, more rapid when the apertures are closed and slower when they are open or vice versa. Controls that are so complicated, however, are not appropriate in practice. Furthermore, when the solids are of the nature of a paste, it is impossible for the baffle to block off the apertures, and the controls are of limited application.

SUMMARY OF THE INVENTION

The object of the present invention is to provide a fully jacketed centrifuge of the known type in which the concentration of solids flowing out of the apertures can be simply controlled no matter what type of solids is being treated and in which complicated controls and drives are not necessary.

This object is attained in accordance with the invention by providing a second inlet space with an access and channels and which is associated with the apertures.

The concentration of solids emerging from the apertures is controlled by constantly returning part of the solids that emerge from the apertures back into the second inlet space through the access, whence it flows through the channels directly into the vicinity of the apertures, where it mixes with the sedimented solids. The apertures can be very large, even when the centrifuged material has a low proportion of solids, in order to prevent clogging.

In one preferred embodiment of the invention the channels in the second inlet space extend directly into the vicinity of the apertures in the jacket of the drum. The recirculated solids accordingly do not have to penetrate through the clarified phase, which prevents any possible turbidity. This is especially important when the solids are difficult to sediment.

To prevent turbulence in the sedimented solids even in the vicinity of the apertures as a result of the solids emerging from the channels, the channels can empty into an annular channel that connects the apertures. This annular channel can be constituted for example by connecting the channels at the exit by means of a revolving ring that covers an annular recess in the vicinity of the apertures in the jacket of the drum in such a way as to produce access channels to the annular channel through which the centrifuged solids arrive in the annular channel where they mix with the recirculated solids without affecting the clarified phase.

In one particularly practical embodiment of the invention the channels can end directly in the apertures. A catch chamber can be positioned concentric to the second inlet space and have radial pipes in positive communication with the apertures in the jacket of the drum. This makes it possible to mix the recirculated solids with the centrifuged solids direct in the apertures, which allows especially precise dosing. Since the channels now rotate at the same speed as the drum, any agitation on the part of the drum is avoided in terms of the centrifuged solids, and the settling process is not disrupted.

In another embodiment of the invention, the apertures are located in mouthpieces inserted in the jacket of the drum. They can accordingly be easily replaced when worn or when it is necessary to change the diameter.

When the object of the invention is employed in connection with strictly cylindrical drums in which the mouthpiece must reasonably be positioned at the end of the drum jacket that the helical conveyor points toward, the catch chamber, channels, and apertures can be mounted in a practical way in the corresponding front plate of the drum. The centrifuged solids can simultaneously gain access to the apertures through separate bores, each of which communicates with a channel, or through an annular channel in the front plate that is open to the helical conveyor and that the channels and apertures open into.

Some preferred embodiments of the invention will now be described with reference to the attached drawings, wherein

DETAILED DESCRIPTION OF THE PREFERRED EMBODIMENTS

Figure 1:
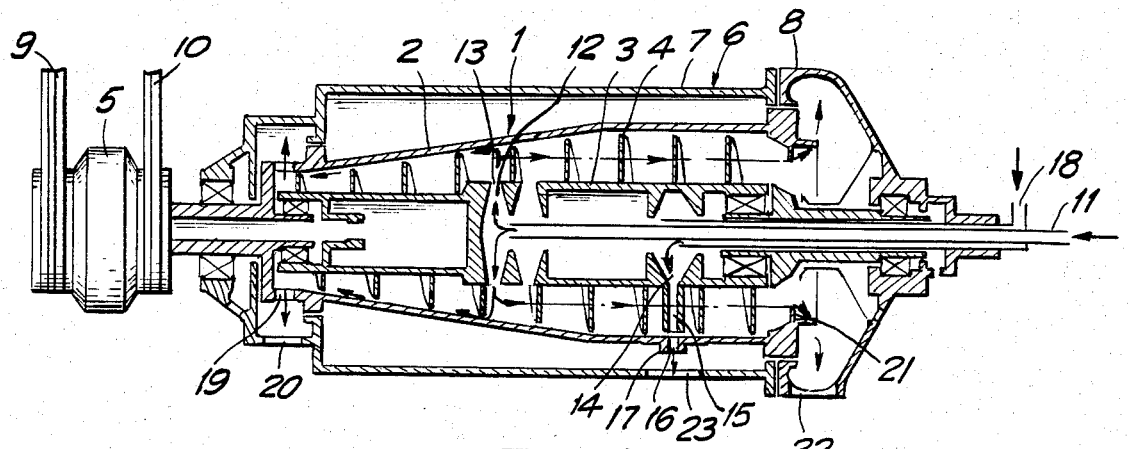
FIG. 1 is a vertical longitudinal section through a fully jacketed centrifuge.

FIG. 1 illustrates a fully jacketed centrifuge consisting of a cylindrical-conical drum 1 with a powered helical conveyor 3 that rotates at a speed different from that of a drum jacket 2 positioned inside it. Helical conveyor 3 has helices 4 that match the inside surface of jacket 2. The difference in speed between the conveyor 3 and jacket 2 is produced by a cyclodrive 5 connected to both. Drum 1 is mounted and rotates in a housing 6 that consists of a a housing jacket 7 and a housing lid 8. Jacket 2 and conveyor 3 are powered through cyclodrive 5 by means of an electric motor, not illustrated, that rotates the cyclodrive and hence the jacket and the conveyor at fixed speeds through V belts 9 and 10.

The material to be centrifuged arrives in drum 1 through access 11, inlet space 12, and outlet apertures 13. There is another inlet space 14 in helical conveyor 3 for recirculating the solids. Second inlet space 14 communicates with channels 15 that extend in the vicinity of apertures 16 in mouthpieces 17 into the vicinity of jacket 2. A separate access 18 is associated with second inlet space 14. Some of the centrifuged solids are conveyed through helical conveyor 3 to extraction apertures 19 and leave the housing through extraction aperture 20. The liquid phase leaves drum 1 over a weir 21 and emerges at a flowoff 22. The lighter and more difficult to convey solids do not sediment the liquid phase is on the way to weir 21 and are diverted through apertures 16 and another flowoff 23.

The concentration of solids flowing off out of apertures 16 is controlled by constantly returning part of the solids that emerge from flowoff 23 back into the drum through access 18, whence it flows through second inlet space 14 and channels 15 directly into the vicinity of apertures 16. A process of this type is easy to automate.

Figure 2:
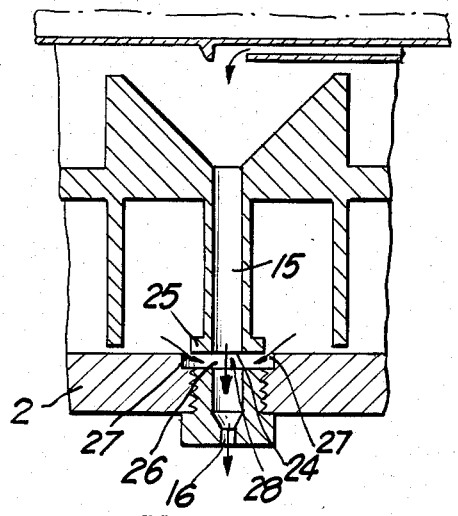
FIG. 2 is a sectional detail of a second inlet space with channels that empty into an annular channel.

The channels 15 in the embodiment illustrated in FIG. 2 are connected at their exit 24 by a revolving ring 25 that covers an annular recess 26 in the jacket 2 of the drum in the vicinity of apertures 16 in such a way as to leave an annular channel 28 with access channels 27.

Figure 3:
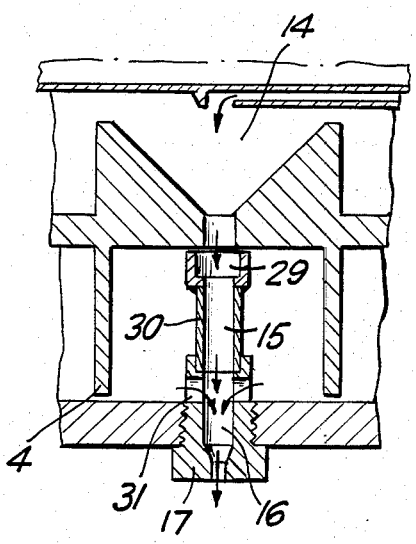
FIG. 3 is a sectional detail of a second inlet space with channels that empty directly into the apertures.

FIG. 3 illustrates a catch chamber 29 that is positioned concentric to second inlet space 14. Channels 15 are inside radial pipes 30 leading from catch chamber 29. Since pipes 30 are positively connected to mouthpieces 17, channels 15 empty directly into apertures 16. The precipitated solids also arrive in apertures 16 through bores 31 in mouthpieces 17 where they now mix with the recirculated solids for the first time. Since the radial pipes 30 of mouthpieces 17 secure and center catch chamber 29, no additional positioning or securing devices are necessary. Since the channels 15 in pipes 30 do not revolve at the same speed as the conveyor as in the embodiments illustrated in FIGS. 1 and 2, but at the same speed as the drum, the helices 4 must be interrupted at that point. Catch chamber 29 must be partitioned for assembly.

Figure 4:
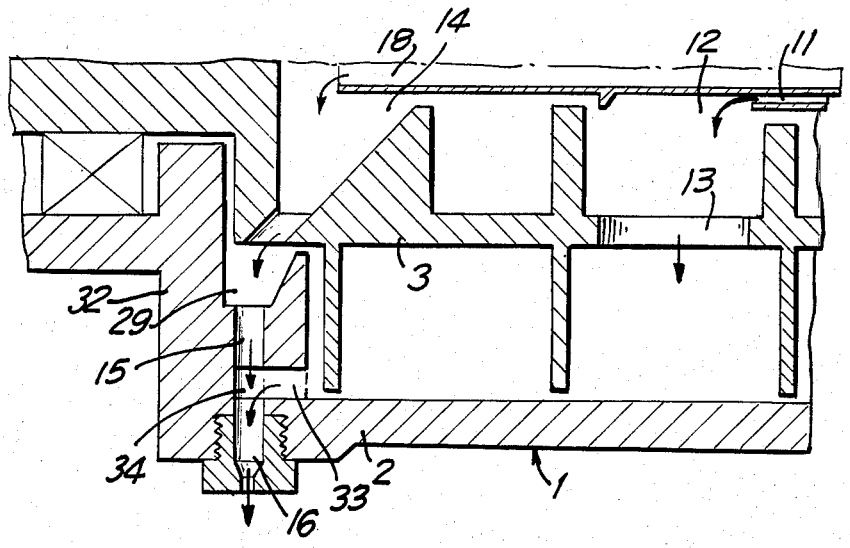
FIG. 4 is a sectional detail of a second inlet space with channels positioned directly in the front plate of the drum.

When the invention is employed with a strictly cylindrical drum jacket, with the solids extracted only through apertures 16, it is unnecessary to partition catch chamber 29 because it will then be a good idea to necessarily position channels 15 and apertures 16 at the end of jacket 2 that the material conveyed by helical conveyor 3 travels toward. Catch chamber 29, channels 15, and apertures 16 can then be positioned as illustrated for example in FIG. 4 in the front wall 32 of drum 1, with channels 15 communicating with the inside of the drum through bores 33. In addition to bores 33 there can be a annular channel 34 that connects channels 15 and apertures 16. The material to be centrifuged is supplied through access 11, inlet space 12, and outlet apertures 13, whereas the solids are conveyed through access 18 and second inlet space 14.

It will be appreciated that the instant specification and claims are set forth by way of illustration and not limitation, and that various modifications and changes may be made without departing from the spirit and scope of the present invention.

What is claimed is:

1. In a fully jacketed centrifuge with a helical conveyor for separating mixtures of solids and liquid, wherein the mixture of solids and liquid is fed into the conveyor through a first inlet space having a first access passage and at least some of the centrifuged solids are extracted through extraction apertures located below the surface of the liquid in the jacket of the drum, the improvement comprising: means forming a second inlet space in the vicinity of the extraction apertures and having a second access passage and outlet channels in communication therewith.

2. The fully jacketed centrifuge as in claim 1, wherein the channels for the second inlet space extend directly into the vicinity of the extraction apertures in the jacket of the drum.

3. The fully jacketed centrifuge as in claim 1, further comprising means forming an annular channel connecting the apertures and into which second inlet space channels empty.

4. The fully jacketed centrifuge as in claim 3, wherein the means forming the annular channel comprising a revolving ring that covers an annular recess in the vicinity of the apertures in the jacket of the drum to from access channels to the annular channel.

5. The fully jacketed centrifuge as in claim 1, further comprising radial pipes that end directly in the apertures and wherein the channels run in the radial pipes and the radial pipes extend out of a catch chamber that is positioned concentric with the second inlet space.

6. The fully jacketed centrifuge as in claim 5, wherein the radial pipes are in positive communication with the apertures in the jacket of the drum.

7. The fully jacketed centrifuge as in claim 5, further comprising mouthpieces inserted in the jacket of the drum and in which the apertures are located.

8. The fully jacketed centrifuge as in claim 7, wherein the mouthpieces are releasably mountable and the catch chamber with the pipes is centered and secured by means of the mouthpieces.

9. The fully jacketed centrifuge as in claim 5, wherein the drum comprises a front wall in which the catch chamber, channels, and apertures are positioned.

10. The fully jacketed centrifuge as in claim 9, wherein the front wall has bores and the centrifuged solids have access to the apertures through the bores in the front wall.

11. The fully jacketed centrifuge as in claim 9, wherein the front wall has an annular channel that communicates with the apertures and channels and the centrifuged solids have access to the apertures through the annular channel.

* * * * *